US007614502B2

(12) United States Patent
Cormack

(10) Patent No.: US 7,614,502 B2
(45) Date of Patent: Nov. 10, 2009

(54) APPARATUS AND METHOD FOR MAKING AND SORTING ARTICLES OF MAIL

(76) Inventor: Cameron Lanning Cormack, 10435-139 Street, Edmonton, Alberta (CA) T5N 2K6

( * ) Notice: Subject to any disclaimer, the term of this patent is extended or adjusted under 35 U.S.C. 154(b) by 395 days.

(21) Appl. No.: 11/238,638

(22) Filed: Sep. 29, 2005

(65) Prior Publication Data

US 2006/0180641 A1 Aug. 17, 2006

(30) Foreign Application Priority Data

Nov. 4, 2004 (CA) ..... 2486817

(51) Int. Cl.
*B03B 11/00* (2006.01)

(52) U.S. Cl. ..... 209/495; 209/3.3; 209/494; 209/584

(58) Field of Classification Search ..... 209/3.3, 209/584; 235/494, 495
See application file for complete search history.

(56) References Cited

U.S. PATENT DOCUMENTS

| | | | | |
|---|---|---|---|---|
| 2,775,405 | A | 12/1956 | Paston | |
| 3,757,942 | A | 9/1973 | Gunn | |
| 3,774,758 | A | 11/1973 | Sternberg | |
| 3,783,246 | A | 1/1974 | Bayer | |
| 3,863,051 | A | 1/1975 | Wilcoxon | |
| 4,117,975 | A * | 10/1978 | Gunn | 235/494 |
| 4,201,339 | A * | 5/1980 | Gunn | 235/487 |
| 4,358,017 | A | 11/1982 | Erikson | |
| 5,329,102 | A * | 7/1994 | Sansone | 235/375 |
| 5,518,122 | A | 5/1996 | Tilles et al. | |
| 5,758,574 | A * | 6/1998 | Bernardo et al. | 101/2 |
| 6,005,945 | A * | 12/1999 | Whitehouse | 380/51 |
| 6,156,988 | A | 12/2000 | Baker | |
| 6,360,001 | B1 * | 3/2002 | Berger et al. | 382/101 |
| 6,865,560 | B1 * | 3/2005 | Sansone et al. | 705/404 |
| 2003/0118191 | A1 * | 6/2003 | Wang et al. | 380/285 |

FOREIGN PATENT DOCUMENTS

| | | |
|---|---|---|
| AU | A-86 229/82 | 7/1982 |
| FR | 2722901 | 1/1996 |
| GB | 1331082 | 9/1973 |
| WO | PCT/IT98/00321 | 11/1998 |

* cited by examiner

*Primary Examiner*—Patrick H Mackey
*Assistant Examiner*—Terrell H Matthews
(74) *Attorney, Agent, or Firm*—Dennis T. Griggs; Scott T. Griggs; Griggs Bergen LLP

(57) ABSTRACT

A pre-printed label is attached to an article of internal or interdepartmental mail. The label is imprinted with a matrix of boxes that are selectively scratched or blackened out by a sender to represent a destination mail stop code. The matrix includes a lead-in marker and a lead-out marker that are detected by an optical scanner of a mail sorting machine to determine the location and orientation of the matrix. The matrix is scanned and the destination mail code is read as the article is processed by the mail sorting machine. The mail sorting machine then determines if the mail stop code matches a known destination and, if so, routes the article to a mail receptacle corresponding to the mail stop code.

23 Claims, 7 Drawing Sheets

Fig. 8

APPARATUS AND METHOD FOR MAKING AND SORTING ARTICLES OF MAIL

FOREIGN PRIORITY CLAIM

This application claims priority under 35 U.S.C. §119(a)-(d) from Canadian Application No. 2,486,817 filed Nov. 4, 2004.

FIELD OF THE INVENTION

The present invention is related to the field of machine-readable labels for articles of mail that are sorted by automated mail sorting machines. More specifically, the present invention relates to machine-readable address labels for articles of mail and interdepartmental mailing envelopes that are sorted by automated internal-mail sorting machines.

BACKGROUND OF THE INVENTION

Large organizations such as corporations and universities, to name but a few, can have large quantities of mail to be routed between departments and individuals within the organization. In such organizations, it is known to use mail sorting machines to automate the sorting and routing of mail from one destination to another.

A number of schemes are known to read the destination addresses of an article of mail using such a mail sorting machine. One method is to use optical character recognition techniques to "read" the destination address written on the article of mail by the sender. The accuracy of such a method, however, is greatly variable on the legibility of the sender's handwriting.

Another method is to use a label affixed or printed on an article of mail consisting of a matrix of boxes containing alphanumeric characters that are marked to indicate a code, such as a mail stop or zip code, representing the destination address of the article. The limitation of such a method requires that the label be presented to the mail sorting machine in a particular and precise orientation so that it may be properly "scanned" by the machine in order to determine the boxes marked in the matrix and, hence, the destination address of the article.

Another method is to print a bar code on the article representing the destination address that may be scanned by the mail sorting machine. The limitation of this method is that the bar code needs to be printed by a machine. The sender cannot simply mark a destination code on the article by hand.

It is, therefore, desirable to have an apparatus and method for marking the destination address of an article of mail that can be easily marked by hand by the sender and yet be easily read by a mail sorting machine without having the article to be exactly and precisely aligned with the machine in order to be read.

SUMMARY OF THE INVENTION

The present invention is an apparatus and method of marking articles of mail that are sorted by an automated internal mail sorting machine.

The apparatus of the present invention is a pre-printed label that can be affixed to an article of mail. The label comprises a matrix of columns and rows forming a number of boxes equal to the product of a number of columns and the number of rows. Within each box is a printed alphanumeric character that may be scratched or blackened out by marking the box with a writing instrument. Preferably, the characters are ascending in order from left and right within each row of the matrix.

In an alternate embodiment of the apparatus, the matrix may be pre-printed on an envelope itself. In internal or inter-office mail systems, an envelope may be printed with a number of such matrices such that it can be used over again until all of the preprinted matrices have been used.

The number of columns and rows of the matrix is variable although, preferably, the number of columns in the matrix will range from 3 to 10 and the number of rows in the matrix will range from 2 to 4. Each known destination address or mail stop within the organization will be assigned a specific or unique code representing the mail stop or destination address. Any number of marking codes or techniques may be used to identify the mail stop or destination addresses, as well known by those skilled in the art. To aid the mail sorting machine in reading the matrix on an article, the assignment of codes to mail stops may include the rule of not repeating alphanumeric characters in the mail stop code. By following this rule, a column will never have more than one marked box. This will increase the accuracy of determining the mail stop code when the matrix is scanned by a mail sorting machine.

To aid the ability of a mail sorting machine to read the matrix, the matrix further comprises a lead-in marker of a pre-determined pattern. The lead-in marker may be placed in any position but it is, preferably, placed adjacent to the left side of the matrix when the matrix is viewed in an upright orientation. The pattern can take on any number of forms. In the present invention, the lead-in marker preferably consists of a series of alternating black and white vertical lines of varying thicknesses from left to right. The lines do not have to be exactly "black and white." The lines just need to be sufficiently distinguishable from each other in contrast from one line to the next so as to be readable by the optical scanner of a mail sorting machine.

In addition to the lead-in marker, the matrix further comprises a lead-out marker of a second predetermined pattern. The lead-out marker may be placed in any of the remaining positions surrounding the matrix but it is, preferably, placed adjacent to the right side of the matrix. The lead-out marker is one that is distinguishable from the lead-in marker. Like the lead-in marker, the lead-out marker can take on a number of forms. In the present invention, the lead-out marker preferably consists of a series of alternating white and black vertical lines from left to right. Similar to the lead-in marker, the lines need not be pure white and black, they just need to be sufficiently distinguishable in contrast from one line to the next. The lines of the lead-in and lead-out markers may also comprise breaks to indicate the junction between adjacent rows of the matrix.

In operation, the matrix is printed onto a label that can be affixed to an article of mail or may be printed on an envelope. The sender simply scratches or blackens out the boxes on the matrix that represents the mail stop code of the intended recipient of the article of the mail. For organizations with internal mail systems, the use of such a matrix speeds the operation of sorting and determining the destination of an article of mail by the use of an automated mail sorting machine.

In determining the destination code of an article of mail having a label of the present invention affixed to it, the article is passed under the optical scanner of a mail sorting machine such that the label is visible to the scanner. The scanner scans the article to produce an electronic image of the article. The mail sorting machine identifies the lead-in and lead-out markers in the image so as to further determine the location and orientation of the label and how much, if any, the label is skewed from a perpendicular or upright orientation. By knowing how much the label in the image is skewed from an upright orientation, the mail sorting machine can use this information to then determine which boxes in the label's matrix is scratched or blackened out.

Upon determining which boxes are marked, the mail sorting machine produces an output value string representative of the mail stop code marked on the label. The mail sorting machine then compares the output value string to a data base of destination codes representing destinations known to the mail sorting machine. If the output value string matches the destination code of a destination known to the mail sorting machine, the mail sorting machine then produces an output signal indicating that the destination of the article of mail is the destination associated with the matched destination code.

In further operation of the present invention, if the mail sorting machine compromises receptacles for destinations known to the mail sorting machine, the machine uses the foregoing process, instead of producing an output signal, or in addition to producing the output signal, to move the article of mail and deposit it into a receptacle corresponding to the destination associated with the matched destination code.

According to one aspect of the present invention, a machine-readable label capable of being imprinted on or affixed to an article of mail includes a printed matrix having a first plurality of columns and a second plurality of rows, and the matrix having a left side and a right side when viewed in an upright orientation. The intersection of each columns with each row forms a box, whereby a matrix of "m" columns and "n" rows comprises "m" times "n" boxes is formed. Each box contains an alphanumeric character that is capable of being scratched or blackened out. A lead-in marker of a first predetermined pattern is imprinted adjacent to a first side of the matrix and a lead-out marker of a second predetermined pattern is imprinted adjacent to a second side of the matrix. The lead-in and lead-out markers are used by an optical reader of a mail sorting machine to determine the location and orientation of a label relative to the optical scanner of the sorting machine.

According to another aspect of the present invention, a method is provided for manually marking a mail stop on an article for automated reading and conversion of the mail stop to a machine-readable code. The method includes the steps of applying to or printing on the article a machine-readable label comprising a printed matrix having a first plurality of columns and a second plurality of rows with the intersection of each of the columns with each of the rows forming a box containing an alphanumeric character that is capable of being scratched or blackened out; manually scratching or blackening out the boxes to designate characters that correspond to the mail stop address, and reading the boxes by an optical scanner of a mail sorting machine.

According to yet another aspect of the invention, the destination of an article is determined with reference to a machine-readable label affixed to or printed on the article. The label has boxes that are selectively scratched or blackened out to represent the destination of the article. The article is moved past the optical reader such that the optical reader can scan the label on the article and produce an electronic image of the article. Lead-in and lead-out markers on the label also appear in the electronic image to determine the location and orientation of the label relative to the optical scanner. An output value string is produced that is representative of the boxes scratched or blackened out on the label. The output value string is compared to a database of destinations known to the mail sorting machine. Each known destination has a unique destination code stored in the database. If the output value string matches a destination code stored in the database, an output signal indicates that the destination of the article is the destination associated with the matched destination code. The mail sorting machine then moves and deposits the article into the mail receiving receptacle that corresponds to the destination associated with the matched destination code.

DETAILED DESCRIPTION OF THE PREFERRED EMBODIMENT

Figure 1:
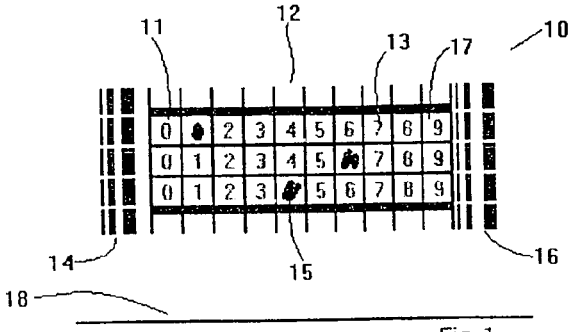
FIG. 1 is a front view of a first embodiment of the apparatus of the present invention.

Referring to FIG. 1, apparatus 10 of the present invention is illustrated. Apparatus 10 consists of matrix 12 having a plurality of boxes 11. Apparatus 10 may be printed on a label that may be affixed to an article of mail to be sent by a sender to an addressee. Alternatively, apparatus 10 may be printed directly to an envelope (not shown) to be sent from the sender to addressee.

Matrix 12 may consist of any number of columns and rows but, preferably will have 3 to 10 columns and 2 to 4 rows. In each box 11 is an alphanumeric character 13. Preferably characters 13 represent a series of numerals listed in ascending order from left to right in each row with either a "0" or a "1". To the left of matrix 12 is lead-in marker 14. To the right of matrix 12 is lead-out marker 16. Located below matrix 12 is addressee line 18 that is used by the sender to write the name of the addressee.

Lead-in marker 14 is a first unique pattern to designate the left side of matrix 12 when scanned by an optical scanner of a mail sorting machine. While the pattern can be of any configuration, lead-in marker 14 is, preferably, a series of vertical lines of alternating black and white lines from left to right. The lines need not be exactly black and white, but do need be of alternating contrast so that an optical scanner can distinguish one line from another. For the purposes of this specification, a "black line" will include lines of darker contrast whereas a "white line" will include lines of lighter contrast. The preferred embodiment of lead-in marker 14 consists of, in this order, a black line of width "X," a white line of width "X," a black line of width "2X", a white line of width "2X", a black line of width "4X" and a white line "4X". The variable "X" is, preferably, in the range of 0.005" to 0.1".

Similarly, lead-out marker 16 is a second unique pattern to designate the right side of matrix 12 when scanned by an optical scanner. While the pattern can be of any configuration, lead-out marker 16 is, preferably, a series of vertical lines of alternating white and black lines from left to right. The preferred embodiment of lead-out marker 16 consists of, in this order, a white line of width "X," a black line of width "X," a white line of width "2X", a black line of width "2X", a white line of width "4X" and a black line "4X". In other words, lead-out marker 16 can comprise a "negative" image of lead-in marker 14.

The mail stop of the addressee is a code that is identified by the sender blackening out characters 13 to produce marked characters 15. For improved accuracy when being scanned by an optical scanner of a mail sorting machine, the marking of mail stops on apparatus 10 may be limited such that each column may only have up to one box 11 marked. In a matrix 12 having 10 columns and three rows, for example, the total number of discreet mail stops is available is 720.

Figure 2:
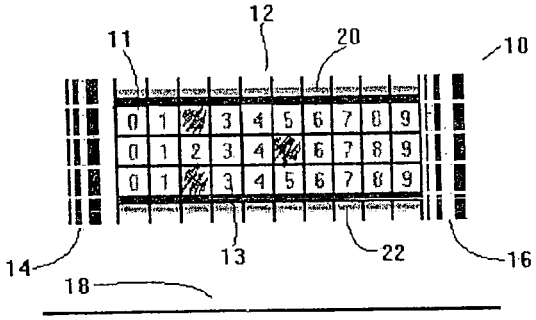
FIG. 2 is a front view of a second embodiment of the apparatus of the present invention.

An alternate embodiment of apparatus 10 is shown in FIG. 2. In this embodiment, matrix 12 further compromises registration lines 20 and 22. Registration lines 20 and 22 permit the optical scanner to have greater precision in determining which boxes 11 have blackened characters 15 thereby removing the restriction of having only one blackened character 15 in each column and thereby increasing the total number of available mail stop addresses to 1,000 for matrix 12 having 10 columns and 3 rows.

Figure 3:
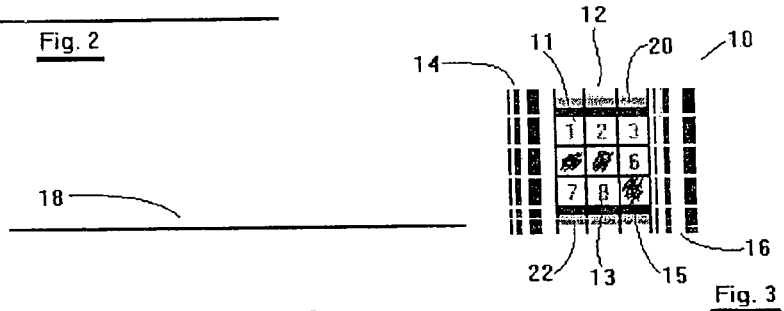
FIG. 3 is a front view of a third embodiment of the apparatus of the present invention.
Figure 4:
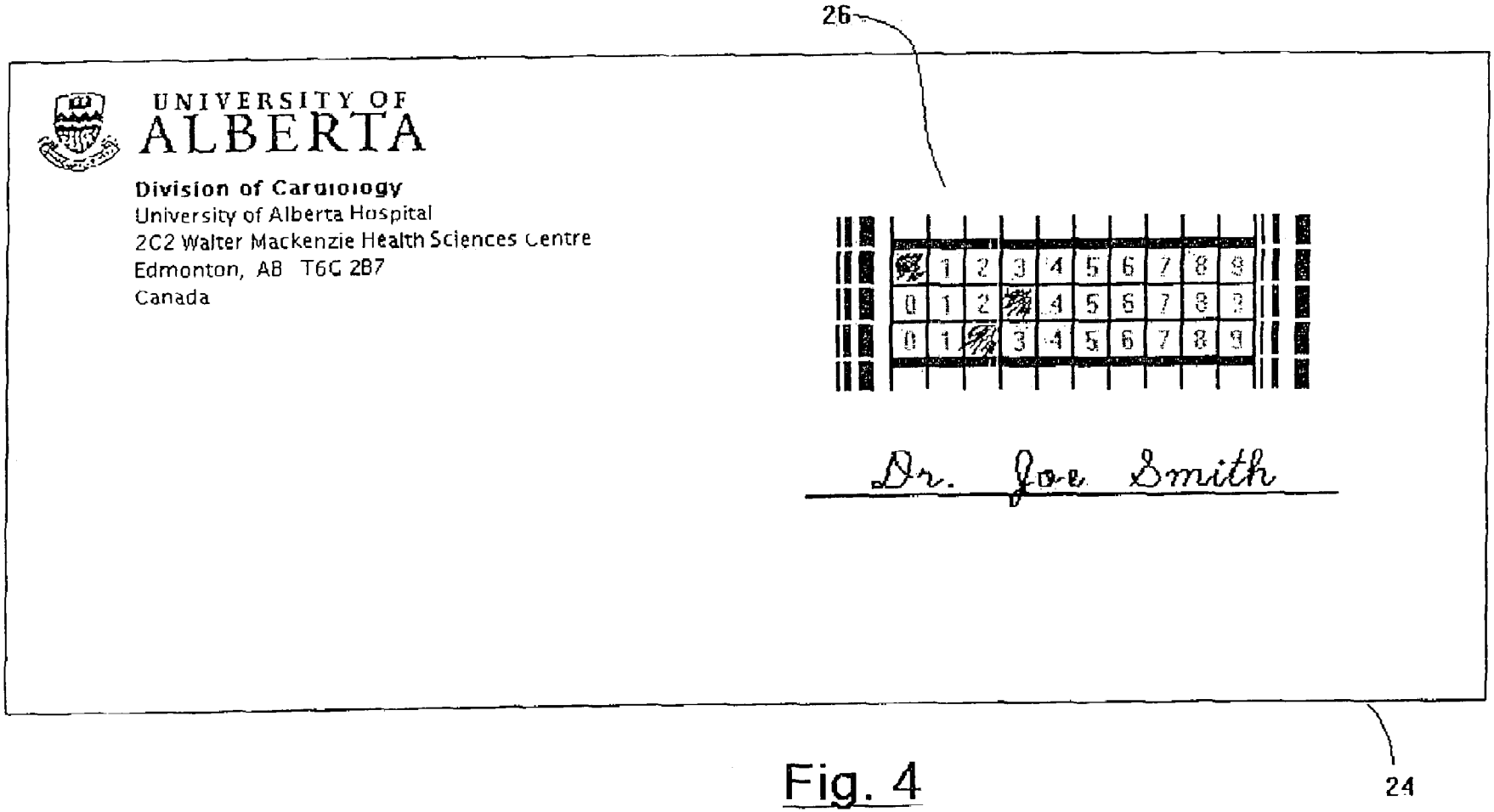
FIG. 4 is a front view of an envelope having a label printed with the apparatus of the present invention.

In FIG. 3, a 3-column by 3-row version of apparatus 10 is shown. In this example, addressee line 18 is positioned to the left of matrix 12. In FIG. 4, envelope 24 is shown having a label 26 preprinted with matrix 12.

Figure 5:
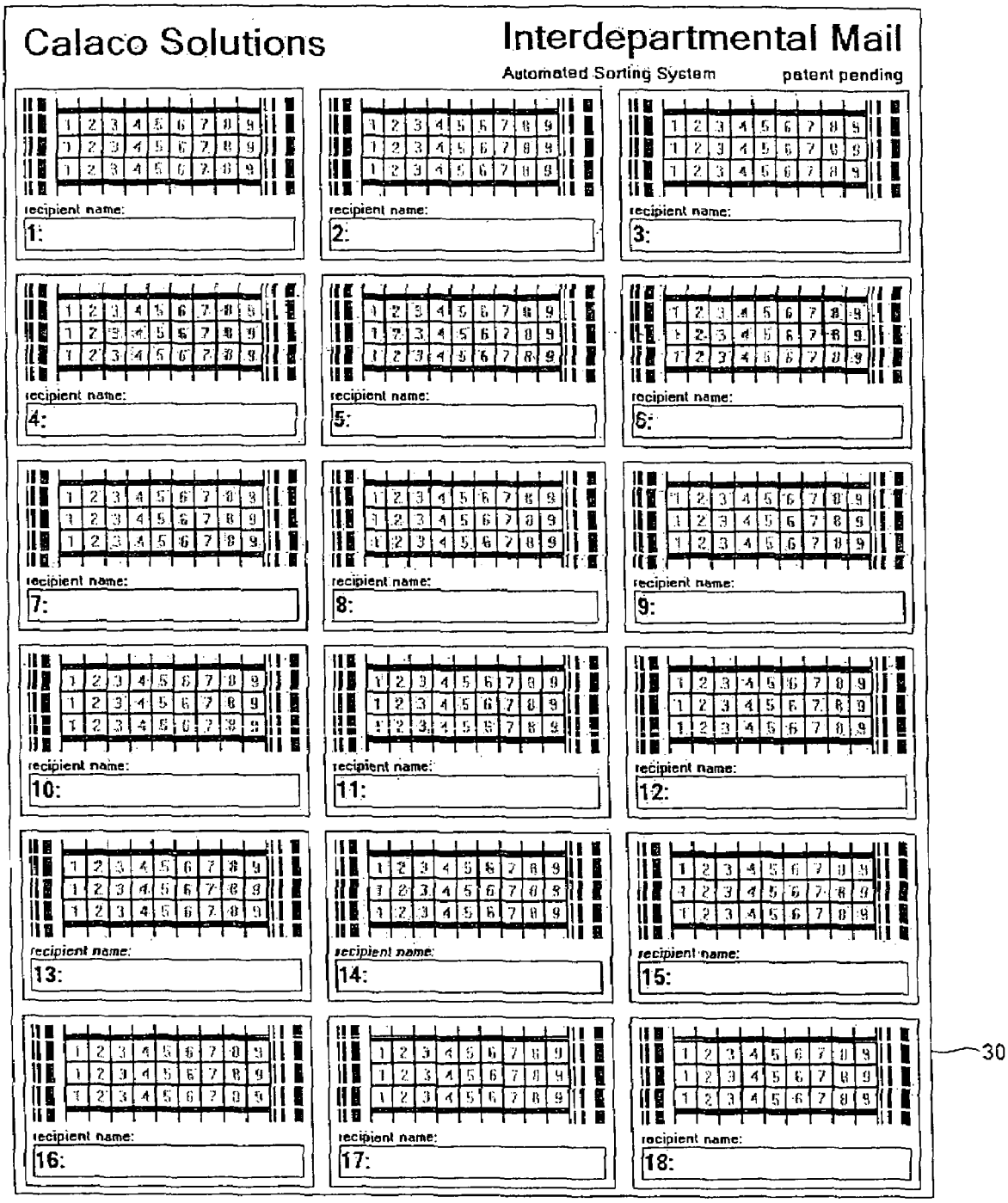
FIG. 5 is a front view of a first embodiment of an internal mail envelope printed with the apparatus of the present invention.
Figure 6:
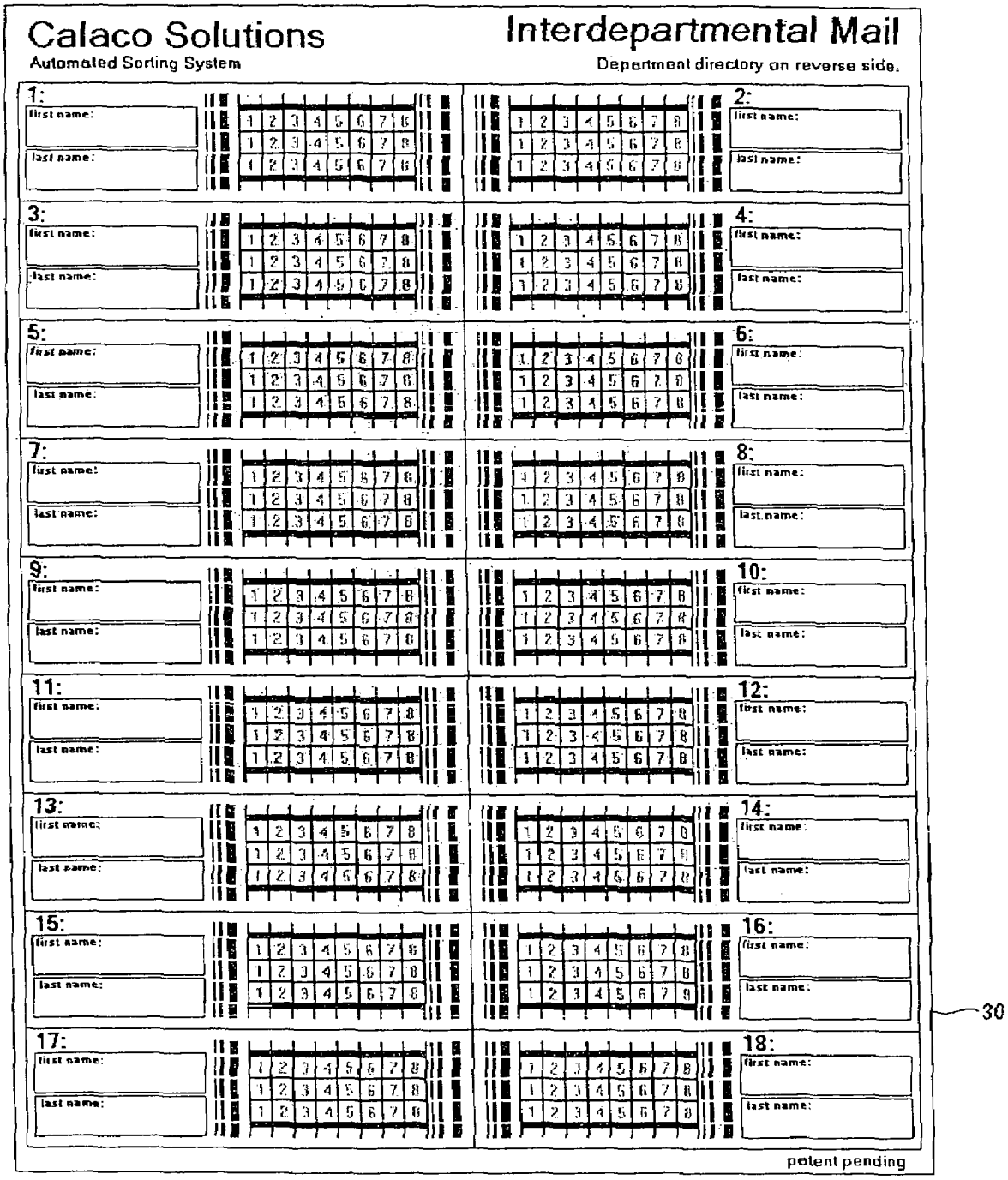
FIG. 6 is a front view of a second embodiment of an internal mail envelope printed with the apparatus of the present invention.
Figure 7:
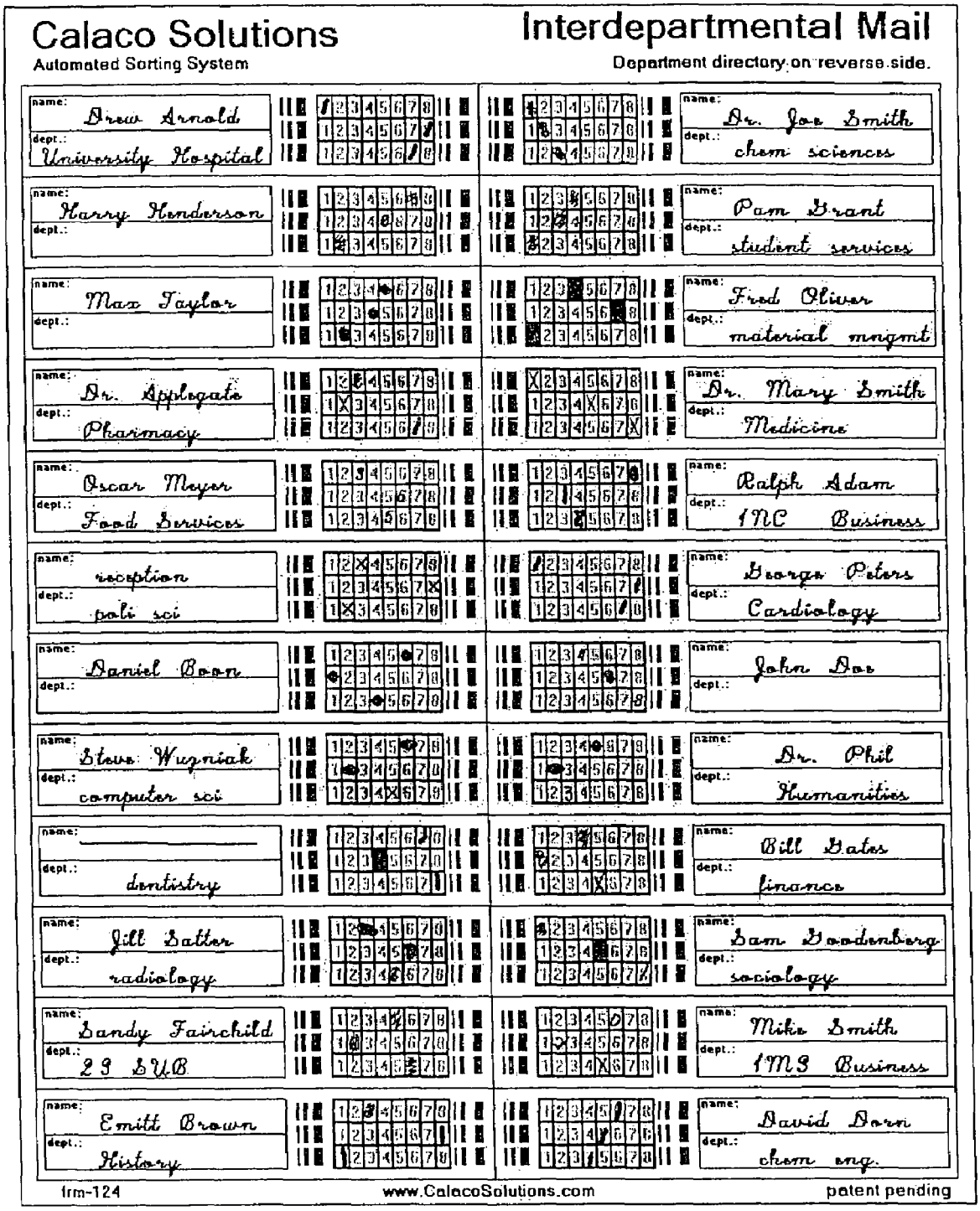
FIG. 7 is a front view of a second embodiment of a printed envelope having the apparatus of the present invention marked with destination mail stops.

In FIG. 5, an envelope 30 is shown having a number of apparatuses 10 printed on it. In this example, apparatus 10 appears 18 times in a configuration comprising of 3 columns and 6 rows. In FIG. 6, an another example of envelope 30 is shown but, in this case, the printing of apparatus 10 is done having 2 columns and 9 rows on envelope 30. FIG. 7 illustrates a sample of this version of envelope 30 having all of its apparatuses 10 filled out with mail stops and names of addressees.

Envelope 30, in each of the foregoing examples, is an envelope for use in an internal or interdepartmental mail system of an organization, such as a corporation or a university to name but a couple of examples. By printing apparatus 10 on envelope 30 a number of times, envelope 30 may be used over and over until every apparatus 10 has been filled out to successive number of addressees.

Figure 11:
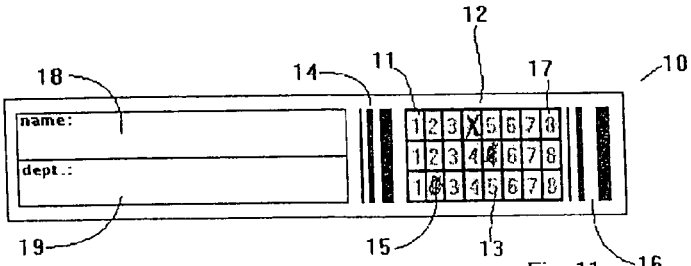
FIG. 11 is a front view of fourth embodiment of the apparatus of the present invention.
Figure 12:
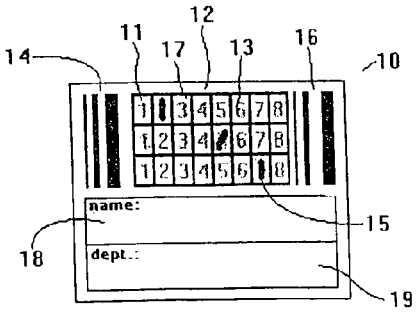
FIG. 12 is a front view of fifth embodiment of the apparatus of the present invention.
Figure 13:
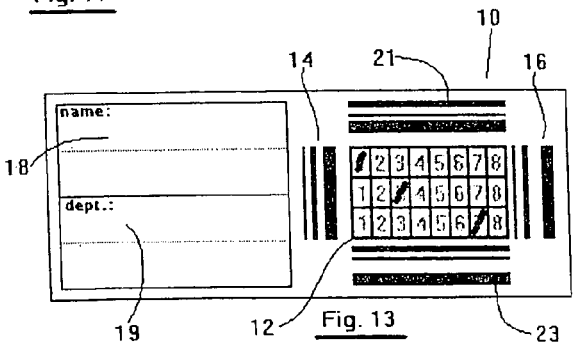
FIG. 13 is a front view of sixth embodiment of the apparatus of the present invention.

Referring FIGS. 11 to 13, other embodiments of apparatus 10 are shown. In FIG. 11, apparatus 10 includes addressee line 18 and addressee department line 19 to the left of matrix 12. In FIG. 12, addressee line 18 and addressee department line 19 appear below matrix 12. Addressee line 18 provides a space for the addressee's name to be written or typed in whereas addressee department line provides a space the addressee's department name to be written or typed in.

Figure 14:
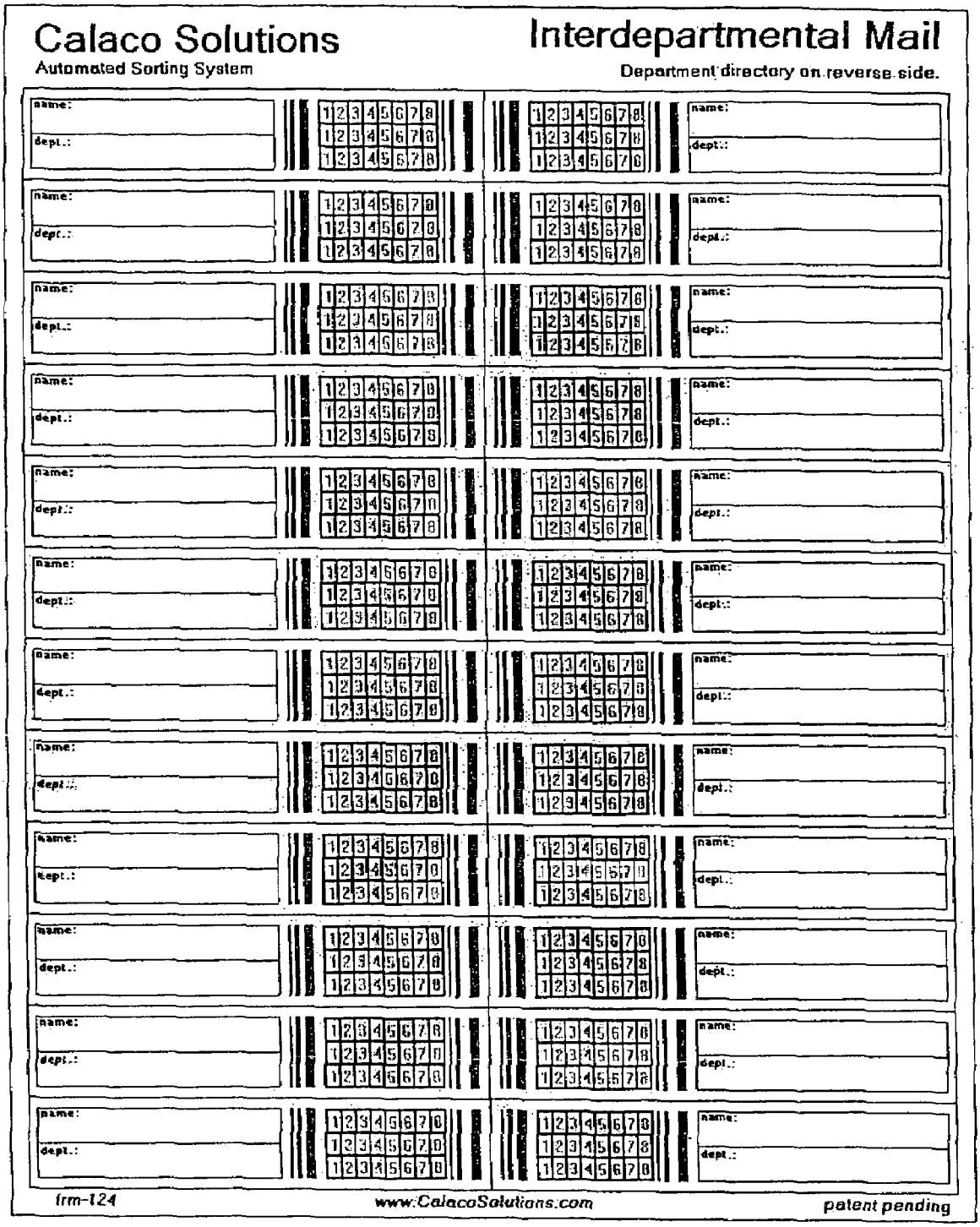
FIG. 14 is a front view of a third embodiment of an internal mail envelope printed with the apparatus of the present invention.

In FIG. 13, matrix 12 further comprises upper lead-in marker 21 located above and lower lead-out marker 13 located below. Upper lead-in marker 21 and lower lead-out marker 23 may be used in place, or in addition to, lead-in marker 14 and lead-out marker 16 by a mail sorting machine to determine the location and orientation of matrix 12 on an article of mail. Referring to FIG. 14, another embodiment of envelope 30 is shown having apparatus 10 printed 24 times in a 2-column by 12-row configuration.

In operation, matrix 12 of apparatus 10 is marked by scratching or blackening out boxes 11 so as to produce blackened characters 13. Boxes 11 need not be completely blackened, only marks sufficiently such that the marks contrast with the background color of 17 of matrix 12.

Figure 9:
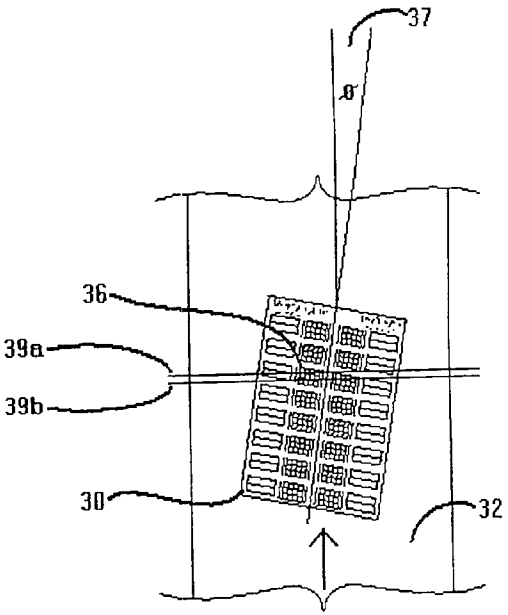
FIG. 9 is a top of view of an article marked with the apparatus of the present invention being scanned by an optical reader of a mail sorting machine.
Figure 8:
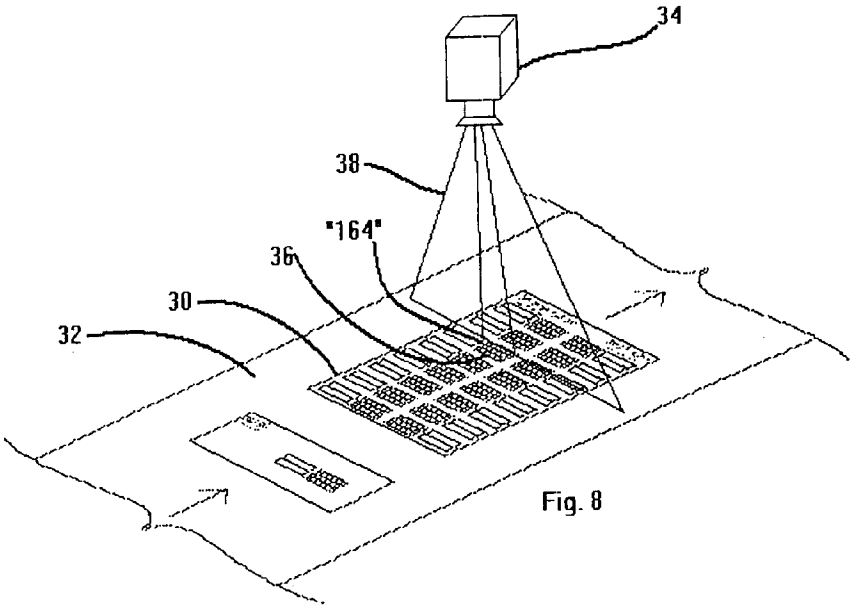
FIG. 8 is a perspective view of an article marked with the apparatus of the present invention being scanned by an optical reader of a mail sorting machine.

In FIG. 8, an envelope 30 is showing moving on conveyor 32 under optical scanner 34 of a mail sorting machine (not shown). Matrix 36, in this case, represents mail stop (164) and is scanned by scan line 38. In FIG. 9, a top view of envelope 30 passing under optical scan of 34 is shown. In this example, apparatus 36 is being scanned by scan lines 39A and 39B. In actuality, as envelope 30 passes under optical scanner 34, a large number of scans are taken by scanner 34, not just 2 as represented by scan lines 39A and 39B.

As well known by those skilled in the art, optical scanners 34 used in mail sorting machines scan articles of mail using charge-coupled devises that have been configured to read one line at a time. The resolution of such devices used in mail sorting machines is 1 dot high by 1000, 2000 or even 4000 dots wide. As shown in FIG. 9, envelope 30 is positioned not perfectly aligned with the direction of conveyor 32 as envelope 30 passes under optical scanner 34. More often than not, envelope 30 is placed on conveyor 32 such that the envelope is skewed off-center by skew angle 37. By incorporating lead-in marker 14 and lead-out marker 16 on matrix 12, the mail sorting machine can determine what skew angle 37 is and use that information in processing the image of apparatus 36 taken by scanner 34 to determine which boxes 11 have blackened characters 15.

In FIGS. 8 and 9, apparatus 36 is given mail stop "164". Upon scanning apparatus 36, the mail sorting machine will determine that the mail stop written on envelope 30 is "164" and produce an output value string to that effect. The mail sorting machine will then compare the output value string with its internal data base to determine if the output value string matches with the destination code of a mail stop known to the mail sorting machine. If there is a match, the mail sorting machine will then produce an output signal indicating the destination of envelope 30 matches with the destination known to the mail sorting machine.

Figure 10:
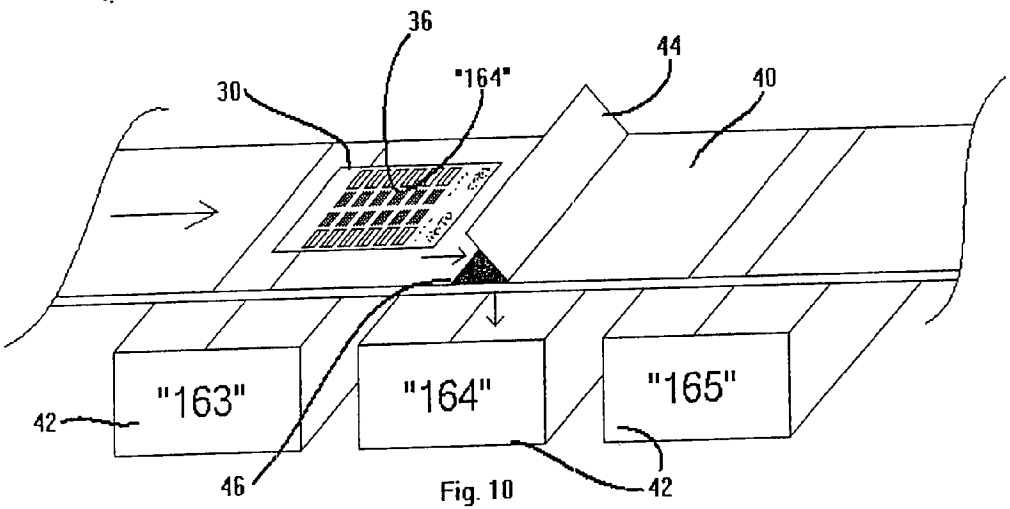
FIG. 10 is a perspective view of an article marked with the apparatus of the present invention being deposited into a destination receptacle by a mail sorting machine.

The mail sorting machine may, in turn, direct envelope 30 to its destination. In FIG. 10, a portion of the mail sorting machine is shown. As the mail sorting machine, in this example, has identified the destination code of envelope 30 as "164", envelope 30 is moved along conveyor 40 until it reaches flap 44. In this example, flap 44 opens such that envelope 30 will move toward opening 46 and then fall through opening 46 thereby being deposited into receptacle 42 which receives all mail to be directed to mail stop "164." While this example illustrates a flap that opens on a conveyor to allow to mail to fall through into a receptacle, it should be obvious to those skilled in the art that any number of methods can be used to direct mail to an intended receptacle apart from the examples shown.

The terms and expressions used in this specification have been used for purposes of description and not of limitation, and there is no intention by the use of such terms and expressions of excluding equivalents of the features shown and described.

I claim:

1. A machine-readable address label capable of being affixed to an article of mail, said label capable of being scanned by an optical reader of a mail sorting machine, said label comprising:

a matrix having a first plurality of columns and a second plurality of rows, said matrix having a left side and a right side when viewed in an upright orientation;

the intersection of each of said columns with each of said rows forming a box, whereby a matrix of "m" columns and "n" rows comprises "m" times "n" boxes, each box containing an alphanumeric character that is capable of being scratched or blackened out;

a lead-in marker of a first predetermined pattern of lines of alternating contrasts adjacent to a first side of said matrix; and a lead-out marker of a second predetermined pattern of lines of alternating contrasts adjacent to a second side of said matrix, whereby said lead-in and lead-out markers are adapted to be scanned by an optical reader of a mail sorting machine so as to determine a skew angle of said label whereby the mail sorting machine can use this information to determine the location and orientation of said label affixed to an article of mail whereby said mail sorting machine can determine which boxes on said label have been scratched or blackened out.

2. The label as set forth in claim 1 wherein each row of boxes comprises a series of alphanumeric characters in ascending order from left to right.

3. The label as set forth in claim 2 wherein each row of boxes comprises a series of numeric characters in ascending order.

4. The label as set forth in claim 3 wherein the number of boxes in each row is in the range of 3 to 10.

5. The label as set forth in claim 1 wherein the number of rows is in the range of 1 to 10.

6. The label as set forth in claim 1 wherein the number of rows is in the range of 2 to 4.

7. The label as set forth in claim 1 wherein said second side is opposite that of the first side on the matrix.

8. The label as set forth in claim 7 wherein said lead-in marker is adjacent to the left side of the matrix when viewed in its upright orientation.

9. The label as set forth in claim 8 wherein the lines of said first predetermined pattern are vertical.

10. The label as set forth in claim 9 wherein said first predetermined pattern, from left to right, is characterized by:

a first black line being X inches wide;

a first white line being X inches wide;

a second black line being 2X inches wide;

a second white line being 2X inches wide;

a third black line being 4X inches wide; and a third white line being 4X inches wide.

11. The label as set forth in claim 10 wherein X is in the range of 0.005 inches to 0.1 inches.

12. The label as set forth in claim 9 wherein if said matrix comprises at least two rows, said vertical lines further comprising a break at each junction between adjacent rows.

13. The label as set forth in claim 7 wherein said lead-out marker is adjacent to the right side of said matrix when viewed in its upright orientation.

14. The label as set forth in claim 13 wherein the lines of said second predetermined pattern are vertical.

15. The label as set forth in claim 14 wherein said second predetermined pattern, from left to right, is characterized by:

a first white line being X inches wide;

a first black line being X inches wide;

a second white line being 2X inches wide;

a second black line being 2X inches wide;

a third white line being 4X inches wide; and a third black line being 4X inches wide.

16. The label as set forth in claim 15 wherein X is in the range of 0.005 inches to 0.1 inches.

17. The label as set forth in claim 14 wherein if said matrix comprises at least two rows, said vertical lines further comprising a break at each junction between adjacent rows.

18. The label as set forth in claim 1 further comprising an addressee line for writing in the addressee's name.

19. The label as set forth in claim 18 further comprising an addressee department line for writing in the addressee's department name.

20. The address label as set forth in claim 1, wherein the matrix and markers are imprinted as machine readable images on an article of mail.

21. The address label as set forth in claim 1, wherein the matrix and markers are imprinted as machine readable images on an adhesive label.

22. The address label as set forth in claim 1, wherein the lead-in marker and the lead-out marker further comprise breaks to indicate a junction between adjacent rows of the matrix.

23. The address label as set forth in claim 1, wherein the lead-out marker further comprises a negative image of the lead-in marker.

* * * * *